US005089028A

United States Patent [19]

Abramo et al.

[11] Patent Number: 5,089,028

[45] Date of Patent: Feb. 18, 1992

[54] DEPOSIT CONTROL ADDITIVES AND FUEL COMPOSITIONS CONTAINING THE SAME

[75] Inventors: Guy P. Abramo, Herndon, Va.; Noyes L. Avery, Bryn Mawr, Pa.; Jeffrey C. Trewella, Flemington, N.J.

[73] Assignee: Mobil Oil Corporation, Fairfax, Va.

[21] Appl. No.: 564,909

[22] Filed: Aug. 9, 1990

[51] Int. Cl.[5] ..... C10L 1/10

[52] U.S. Cl. ..... 44/347

[58] Field of Search ..... 44/347

[56] References Cited

U.S. PATENT DOCUMENTS

| | | | |
|---|---|---|---|
| 3,419,365 | 12/1968 | Sheets | 585/12 |
| 3,443,918 | 5/1969 | Kautsky et al. | 44/63 |
| 3,658,494 | 4/1972 | Dorer | 44/63 |
| 3,658,495 | 4/1972 | Dorer | 44/63 |
| 3,672,852 | 6/1972 | Vermillion et al. | 44/52 |
| 3,676,089 | 7/1972 | Morris et al. | 44/62 |
| 3,753,905 | 8/1973 | Souillard et al. | 252/33.4 |
| 3,852,204 | 12/1974 | Souillard et al. | 252/33.4 |
| 3,996,023 | 12/1976 | Osmond et al. | 44/62 |
| 4,032,304 | 6/1977 | Dorer et al. | 44/70 |
| 4,098,585 | 7/1978 | Vartanian et al. | 44/63 |
| 4,234,435 | 11/1980 | Meinhardt et al. | 252/51.5 |
| 4,325,708 | 4/1982 | Bagnetto | 44/58 |
| 4,409,000 | 10/1983 | LeSuer | 44/70 |

FOREIGN PATENT DOCUMENTS 3838918 5/1990 Fed. Rep. of Germany .

*Primary Examiner*—Brian E. Hearn
*Assistant Examiner*—Maria Nuzzolillo
*Attorney, Agent, or Firm*—Alexander J. McKillop; Charles J. Speciale; Jessica M. Sinnott

[57] ABSTRACT

A fuel additive having detergency, solubility and thermal stability is a mixture of polyalkenyl succinimides, polyalkylenes, i.e., polyisobutylene or polypropylene, an ester and a polyether; namely a polybutylene oxide, polypropylene oxide or polybutylene/polypropylene oxide copolymer, and an optional amount of a mineral oil or synthetic oil.

12 Claims, No Drawings

DEPOSIT CONTROL ADDITIVES AND FUEL COMPOSITIONS CONTAINING THE SAME

FIELD OF THE INVENTION

The invention relates to deposit control additives for fuels. Specifically, the invention relates to a fuel additive comprising a combination of a polyalkylene-substituted succinimide as a detergent/dispersant and a carrier fluid which is a combination of a polymeric component, an ester and a polyether, and optionally a mineral oil or synthetic oil.

BACKGROUND OF THE INVENTION

During operation of an internal combustion engine, fuel and lubricant deposits accumulate and bake onto the intake valves and intake ports of the fuel system. These deposits restrict the flow of air and fuel entering the combustion chamber which can cause stalling and hesitation, especially during "cold-start" operation.

Conventional polyalkenyl succinimides as gasoline detergent additives are described as effective in providing carburetor cleanliness and port fuel injector cleanliness. However, the polyalkenyl succinimides alone offer little intake valve cleanliness performance.

SUMMARY OF THE INVENTION

The present invention offers a gasoline additive which can be used in a minor effective amount as a carburetor, port fuel injector and intake valve cleanliness additive which limits the amount of deposit formation. The components of the additive synergistically clean the fuel system of a spark ignition internal combustion engine, when added to a fuel in an amount of at least 10 to 100, at most 200 to 500 pounds of additive per 1,000 barrels of fuel (lbs/MB). All the fuel system components, particularly the carburetor, fuel lines, fuel injectors, port fuel injectors and intake valves are cleaned by exposure to small amounts of the additive combination in solution with the fuel. The additive formulation of the present invention, when used in minor concentrations, limits the amount of deposit formation.

An advantage of the invention is that it is effective in both high quality premium unleaded as well as regular unleaded gasolines thus providing effective detergency properties for all kinds of vehicles.

The invention is directed to an additive for normally liquid fuels having detergency, solubility and thermal stability comprising a combination of a polyalkenyl succinimide which is the reaction product of a polyalkenyl succinic anhydride and a polyalkylene polyamine, a polymer or copolymer of an olefinic hydrocarbon, an ester and a polyether. Fuel compositions containing the additive and methods of making the same.

The additive contains a range of from at least 10 to 20 to at most 50 to 80 wt. %, based on the total weight of the additive, of an N-substituted polyalkenyl succinimide. The N-substituted polyalkenyl succinimide is made by reacting a polyalkenyl succinic anhydride with a polyamine. The polyalkenyl succinic anhydride has the structural formula:

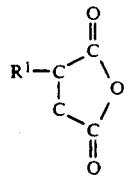

in which $R^1$ is a polyalkenyl radical having a weight average molecular weight from at least 600 to 900 to at most 1,500 to 3,000. The polyalkenyl radical contains at least about 40 to 60 carbon atoms, at most 100 to 300 to carbon atoms. The alkenyl groups are polyolefins made from olefins, typically 1- olefins, containing 2 to 10 carbon atoms. Representative examples of suitable olefins include ethylene, propylene, butylene, isobutylene, pentene, hexene, octene, decene and higher olefins or copolymers thereof. When the polyalkenyl radical is a homopolymer of polyisobutenyl, it contains at least 10 to 20 isobutenyl groups, at most 30 to 60 isobutenyl groups.

The ratio of succinic anhydride groups to alkylene groups ranges from at least 0.5 to 1 to at most 1.1 to 3.5 of succinic anhydride groups to each equivalent weight of substituent groups. Such alkenyl succinic anhydrides are made by known techniques. The polyolefins are made by catalytic oligomerization of the olefin. The polyalkenyl succinic anhydride is made from a mixture of polyolefins and maleic anhydride which are heated to a temperature of from 150° to 250° C., optionally, with the use of a catalyst such as chlorine or peroxide. Approximately one mole of maleic anhydride is reacted per mole of polyalkylene such that the resulting polyalkenyl succinic anhydride has about 1 succinic anhydride group per polyalkylene substituent, preferably 0.8 to 0.9 succinic anhydride groups for each polyalkylene substituent. Another method of making the polyalkenyl succinic anhydrides is described in U.S. Pat. No. 4,234,435 which is incorporated herein by reference in its entirety which discloses the polyalkenyl succinic anhydride characterized by the presence within its structure of at least 1.3 succinic anhydride groups for each equivalent weight amount of the polyalkylene substituent. The reaction equilibrium is such that approximately 80 to 90% of the polyalkenyl succinic anhydride can be together in solution with 10 to 20% of unreacted polyolefin.

The polyalkenyl succinimide is derived from a polyalkylene polyamine having the structural formula:

$$H_2N\left(CH_2\underset{\underset{R^2}{|}}{C}HNH\right)_nH$$

in which $R^2$ is a hydrogen or a low molecular weight alkyl radical. Typically, the low molecular weight alkyl radicals have from at least 1 to 2 carbon atoms and at most 3 to 6 carbon atoms and n is an integer ranging from at least 1 to 2 and at most 4 to 6. Representative examples of $R^2$ alkyl groups include methyl, ethyl, propyl or butyl. Representative examples of suitable polyamines include ethylene diamine, propylene diamine, butylene diamine, diethylene triamine, triethylene tetramine, tetraethylene pentamine, pentaethylene hexamine, dipropylene triamine and tripropylene tetramine. The polyalkylene polyamine can also be a polymer or copolymer of any one of the foregoing polyamines ranging in molecular weight of at least 100 to at most 600.

The alkylene succinic anhydride and the polyamine combine stoichiometrically such that one equivalent of the succinic anhydride reacts with 0.5–1.0 molecular equivalent amounts of the polyamine.

The procedure for making the polyalkenyl succinimide is described in U.S. Pat. No. 3,219,666 and U.S. Pat. No. 4,098,585, which is herein incorporated by reference in its entirety.

The additive formulation also contains a carrier fluid which is a mixture having low temperature fluidity and solvency. The components of the carrier fluid are known to provide a moderate amount of intake valve cleanliness when mixed with fuels. However, although the components alone provide a moderate level of intake valve detergency/cleanliness, they do not provide carburetor and port fuel injector detergency/cleanliness. Yet, it was discovered that when used in the present additive formulation, these fluids together in combination with the polyalkenyl succinimides provide superior intake valve detergency as well as port fuel injector and carburetor detergency.

The carrier fluid contains less than 80 wt. %, i.e., at least 10 to 25% to at most 70 to 80%, preferably 20 to 50%, by weight of the total weight of the additive, of a polymer or copolymer of an olefinic hydrocarbon. The polymer has a weight average molecular weight of at least 600 to 900 to at most 1,500 to 3,000. The polymer, typically, has a viscosity ranging from 200 SUS at 100° C. and about 20,000 SUS at 100° C. The polymer is prepared from a monoolefin, diolefin or polyolefin. The olefin can have 1 to 2 ethylenically unsaturated double bonds which are conjugated or unconjugated. The polymer contains at least about 40 to 60 carbon atoms, at most about 100 to 300 carbon atoms. Representative examples of suitable olefins from which the polymers or copolymers are derived include, but are not limited to, ethylene, propylene, 1-butylene, 2-butene, isobutylene, pentene, hexene, butadiene, octene, isoprene and decene or higher olefins. Mixtures of the foregoing, such as a 1 to 1 mixture of isobutylene and 1-butylene are also used. Olefinic copolymers derived from any of these olefins are also suitable. Polyisobutylene, as an example of a suitable polymer for use in this invention, contains at least 10 to 20 isobutylene groups, at most 30 to 60 isobutylene groups. The polymeric component is used in an additional amount and is considered independent from any unreacted polymeric components which may be present in the final additive mixture from the reaction of the anhydride.

The carrier fluid also contains an ester which is made by known techniques or is readily available from commercial sources. The amount of the ester is from 1 to 80 wt. % based on the entire weight of the additive, more specifically, 2 to 60 wt. % or, even more specifically, 5 to 20 wt. %.

The ester is based on an ester of aliphatic or aromatic carboxylic acids, i.e., a mono-, di-, tri- or tetra-carboxylic acid. The aromatic ester can contain over 22 carbon atoms and can have a molecular weight ranging from 300 to 1,500, specifically, 400 to 1,200. To make the aromatic or aliphatic ester, a carboxylic acid substituted benzene or aliphatic compound is reacted with a linear alcohol containing at least 4 to 8 to at most 16 to 20 carbon atoms or a branched Oxo-alcohol containing at least 6 to 8, at most 16 to 20 carbon atoms. Representative examples of the alcohols from which the ester is derived include monohydric alcohols such as n-butanol, i-butanol, t-butanol, isopentyl alcohol and Oxo alcohols, which are prepared by the Oxo process. The Oxo process involves reacting olefins with carbon monoxide and hydrogen at temperatures of about 150° to 200° C. and pressures of about 30 to 400 atmospheres in the presence of a suitable catalyst. Examples of Oxo alcohols are those alcohols having 6 to 20 carbon atoms such as 2-methyl pentanol, 2-ethylhexanol, isodecanol, dodecanol and tridecanol. The foregoing alcohols are also readily available from commercial sources.

There are other ways to make the ester which are known in the art. These methods are best described in Kirk-Othmer "Encyclopedia of Chemical Technology," Vol 9, pages 291–309, John Wiley and Sons, New York, 1980. Such as, direct synthesis by reacting an organic alcohol and the carboxylic acid substituted benzene with elimination of water (see Kirk-Othmer "Encyclopedia of Chemical Technology" Volume 9, pages 306–307, John Wiley & Sons, New York, 1980). Additionally, a method for making the esters is described in U.S. Pat. No. 4,032,550 and in U.S. Pat. No. 4,032,304 which are both incorporated by reference in their entirety.

The carrier fluid also contains a polyether. The amount of the polyether is about 1 to 80 wt. % based on the entire weight of the additive, more specifically, 2–60 wt. % or 5–20 wt. %. The polyether is derived from an alkylene oxide such as an epoxide having the structural formula:

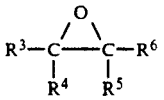

Where $R^3$, $R^4$, $R^5$ and $R^6$ are independently hydrogen atoms or lower hydrocarbyl radicals having 1 to 20 carbon atoms. Representative examples of the oxide include polymers or copolymers of ethylene oxide, propylene oxide, butylene oxide, pentene oxide, hexene oxide, octene oxide and decene oxide and isomers thereof. A representative example of a suitable copolymer is a polypropylene/polybutylene oxide. Mixtures of any of the foregoing oxides are also suitable. The alkylene oxide is initiated by monofunctional or polyfunctional alcohols or amines ranging in molecular weight from 20–400 or an alkyl phenol ranging in molecular weight from 100 to 3,000, preferably 500–1,000. The alcohols are represented by the structures $R'(OH)n$ and $R'(C_6H_5OH)n$, respectively, in which R' is a substantially saturated aliphatic hydrocarbon radical containing 4 to 20 carbon atoms and n is an integer ranging from 1 to 3. The polyethers have a molecular weight of at least 500, specifically, 600 to 3000.

In another, similar, embodiment, the ester and polyether components of the present carrier fluid are described in German patent application publication DT-OS 38 38 918 which is incorporated by reference in its entirety. The foregoing publication describes suitable esters having a minimum viscosity of 2 centistokes at 100° C. The esters are polyol esters based on neopentyl glycol, pentaerythritol or trimethylolpropane with corresponding monocarboxylic acids, oligomer esters and polymer esters such as those based on dicarboxylic acid, polyol and monoalcohol. Certain named esters are the adipates, phthalates, isophthalates, terephthalates and trimellitates of iso-octanol, iso-nonanol, iso-decanol and iso-tridecanol and mixtures thereof. The polyethers are derived from aliphatic and aromatic mono-, di-, or polyalcohols, amines and alkylphenols. The polyether starting materials named in the publication include hexanediol, iso-tridecanol, iso-nonylphenol, isododecylphenol and iso-tridecylamine.

The carrier fluid can optionally contain at least 1 to 10% or 5 to 30%, at most 50 to 80% of a mineral oil or synthetic oil which is used in addition to the polymeric, ester or polyether carrier fluid components. Representative of a suitable mineral oil is a solvent refined, naphthenic mineral oil or a hydrotreated naphthenic mineral oil or a paraffinic mineral oil of at least 100 SUS at 100° C., more specifically at least 300 to 500 SUS to at most 900 to 1200 SUS at 100° C. Representative of synthetic oils are polyolefins such as those derived from ethylene, propylene, 1-butene, hexene, octene, decene and dodecene and the like and copolymers of the foregoing.

The additive is blended in a concentration of from at least 10 to 100 to at most 200 to 500 pounds of additive per 1000 barrels (lb/MB) of fuel. The liquid fuel can be a liquid hydrocarbon fuel or an oxygenated fuel or mixtures thereof. Other fuels are contemplated as well, such as diesel oils and aviation fuels.

Specifically, however, the fuel compositions contemplated include gasoline base stocks such as a mixture of hydrocarbons boiling in the gasoline boiling rang which is from about 90° F. to about 450° F. This base fuel may consist of straight chain or branched chain hydrocarbons, paraffins, cycloparaffins, olefins, aromatic hydrocarbons, or mixtures thereof. The base fuel can be derived from among others, straight run naphtha, polymer gasoline, natural gasoline or from catalytically cracked or thermally cracked hydrocarbons, alkylate and catalytically cracked reformed stock. The composition and octane level of the base fuel are not critical, and any conventional motor fuel base can be employed in the practice of this invention. However, the invention is best employed in premium unleaded and regular unleaded gasolines, although it is also effective in leaded gasolines. The fuels may be gasoline containing up to 50% alcohol or ethers. Further, the fuel may be an alcohol-type fuel containing over 50% to little or no hydrocarbon. Typical of such fuels are methanol, ethanol and mixtures of methanol and ethanol. Further examples of alcohol fuels are propanols, butanols, pentanols, and higher alcohols. The ether fuels can be methyl tert butyl ether, ethyl tert butyl ether, di-isobutyl ether, tert amyl methyl ether and the like. The fuels which may be treated with the additive included gasohols which may be formed by mixing 90 to 95 volumes of gasoline with 5-10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, the compositions of the instant invention may contain solvents, co-detergents, anti-knock compounds such as tetraethyl lead, anti-icing additives, upper cylinder and fuel pump lubricity additives, antistatic agents, corrosion inhibitors, antioxidants, water scavengers, lead scavengers, dyes, lead octane appreciators, anti-smoke additives and the like.

Along with having excellent detergency properties, the additive packages are effective corrosion inhibitors and provide excellent water shedding and filtration performance.

The following Table I illustrates the relative proportions in which the additive components were mixed to formulate the fuel additive packages of the present invention.

TABLE I

| Example No. | Component | lb Additive/ MB Gasoline |
|---|---|---|
| 1 | i) Polyisobutenyl (PIB) succinimide (MW PIB = 920) | 40 |
| | ii) Polyisobutylene (PIB) (MW = 600) | 36 |
| | iii) Commercial Ester/polyether mixture | 57 |
| 2 | i) Polyisobutenyl (PIB) succinimide (MW PIB = 920) | 40 |
| | ii) Polyisobutylene (PIB) (MW = 600) | 36 |
| | iii) Commercial Ester/polyether mixture | 18 |
| | iv) Mineral Oil (solvent refined naphthenic 500 SUS) | 46 |

A single cylinder intake valve cleanliness test was used to determine the effectiveness of the additive formulation of the present invention. In the test, premium unleaded gasoline containing various quantities of a polyisobutenyl succinimide, polyisobutylene, and a commercial ester/polyether mixture (a BASF Co. product sold under the trademark PLURADYNE CF-14), in which the ester/polyether components were of the kind described herein in accordance with Example 1 was evaluated in a single-cylinder engine (using a 1 OW-30 mineral oil lubricant). After 40 hours of operation at 1100 rpm and 10-12 inches manifold vacuum, the intake valve was removed, its combustion chamber and the gross weight was determined. Deposits were then removed mechanically and the tare weight of the valve was measured in order to calculate the net weight of the deposits.

Table II, below, presents the results of several test runs with premium unleaded gasoline containing the various additive package components indicated as well as the specific formulation of Example 1.

TABLE II

| | CLR Intake Valve Cleanliness Test Results | | | | |
|---|---|---|---|---|---|
| | Concentration (lb/MB) | | | ITV | |
| Run | Polyisobutenyl Succinimide | Ester/ Ether | Polyiso-butylene | Deposit Wt., mg | % Deposits vs Base |
| A | — | — | — | 298 | — |
| B | 50 | — | — | 561 | 188 |
| C | — | 100 | — | 165 | 55 |
| D | — | — | 100 | 109 | 37 |
| E | 40 | 36 | 57 | 47 | 16 |

As the results in Table II show, the use of a polyisobutenyl-succinimide alone at a concentration of 50 lb/MB (Run B) increased intake valve (ITV) deposits 188% as compared to the base fuel alone (Run A). A concentration of 100 lb/MB of the commercial ester/polyether mixture reduced deposits to 55% (Run C) as compared to the base fuel alone (Run A). The polyisobutylene alone at a concentration of 100 lb/MB (Run D) reduced deposits to 37% as compared to the base fuel alone (Run A). However, in Run E, using an additive package of the kind described herein, an unexpectedly large reduction in deposits was observed. The additive package of Example 1, in a concentration of 133 lb of additive per 1,000 barrels of fuel, decreased deposits to 16% (Run E) as compared to the base fuel alone (Run A).

As demonstrated by the results of Table II, although the ester/polyether mixture and polyalkylenes such as polyisobutylene can improve intake cleanliness to some degree (Runs C and D, respectively), these hydrocarbons provide no carburetor or port fuel injector detergency, and therefore cannot be used alone to provide full deposit control. However, full deposit control is obtained when the components are blended together in a synergistic additive package.

We claim:

1. A fuel composition comprising a major amount of a fuel and an additive which imparts intake valve deposit inhibiting properties to the fuel comprising a combination of i. a polyisobutenyl succinimide which is the reaction product of a polyisobutenyl succinic anhydride and a polyalkylene polyamine;

ii. a polymer of isobutylene;

iii. an ester which is an adipate, phthalate, isophthalate, terephthalate and trimellitate of iso-octanol, iso-nonanol, iso-decanol, or iso-tridecanol or mixture thereof, polyol ester of neopentyl glycol, pentaerythritol or trimethylolpropane with corresponding monocarboxylic acid, oligomer and polymer ester of dicarboxylic acid, polyol and monoalcohol; and iv. a polyether which is a polymer or copolymer of ethylene oxide, propylene oxide, butylene oxide, pentene oxide, hexene oxide, octene oxide, decene oxide or isomer thereof.

2. The fuel composition described in claim 1 in which the relative proportions of the components of the additive are in an amount of 10 to 80 wt. % of the polyalkenyl succinimide, 10 to 80 wt. % of the polymer or copolymer, 1 to 80 wt. % of the ester and 1 to 80 wt. % of the polyether based on the total weight of the additive.

3. The fuel composition as described in claim 1 in which the polyalkylene polyamine is ethylene diamine, propylene diamine, butylene diamine, diethylene triamine, triethylene tetramine, tetraethylene pentamine, pentaethylene hexamine, dipropylene triamine or tripropylene tetramine.

4. The fuel composition as described in claim 1 in which the polyether has a molecular weight of 500 to 3,000.

5. The fuel composition as described in claim 1 in which the additive further comprises a mineral oil or synthetic oil.

6. The fuel composition as described in claim 1 in which the relative proportions of the components are in an amount of 20 to 50 wt. % of the polyalkenyl succinimide, 25 to 70 wt. % of the polymer or copolymer, 2 to 60 wt. % of the ester and 2 to 60 wt. % of the polyether based on the total weight of the additive.

7. A fuel composition comprising a major amount of a fuel and an additive which imparts intake valve deposit inhibiting properties to the fuel comprising a combination of i. a polyisbutenyl succinimide which is the reaction product of a polyisobutenyl succinic anhydride and a polyalkylene polyamine;

ii. a polymer of isobutylene;

iii. an ester which is an aromatic ester derived from a mon-, di-, tri- or tetra-carboxylic acid substituted benzene compound and a linear alcohol containing at least four carbon atoms or a branched oxo-alcohol containing at least six carbon atoms; and iv. a polyether which is a polymer or copolymer of ethylene oxide, propylene oxide, butylene oxide, pentene oxide, hexene oxide, octene oxide, decene oxide or isomer thereof.

8. The fuel composition as described in claim 7 in which the relative proportions of the components of the additive are in an amount of 10 to 80 wt. % of the polyalkenyl succinimide, 10 to 80 wt. % of the polymer or copolymer, 1 to 80 wt. % of the ester and 1 to 80 wt. % of the polyether based on the total weight of the additive.

9. The fuel composition as described in claim 7 in which the polyalkylene polyamine is ethylene diamine, propylene diamine, butylene diamine, diethylene triamine, triethylene tetramine, tetraethylene pentamine, pentaethylene hexamine, dipropylene triamine or tripropylene tetramine.

10. The fuel composition as described in claim 7 in which the polyether has a molecular weight of 500 to 3,000.

11. The fuel composition as described in claim 7 in which the additive further comprises a mineral oil or synthetic oil.

12. The fuel composition as described in claim 7 in which the relative proportions of the components are in an amount of 20 to 50 wt. % of the polyalkenyl succinimide, 25 to 70 wt. % of the polymer or copolymer, 2 to 60 wt. % of the ester and 2 to 60 wt. % of the polyether based on the total weight of the additive.

* * * * *